US007258764B2

(12) United States Patent
Mauler

(10) Patent No.: US 7,258,764 B2
(45) Date of Patent: Aug. 21, 2007

(54) SOFT AND STRONG WEBS FROM HIGHLY REFINED CELLULOSIC FIBRES

(75) Inventor: Dirk Mauler, Ilvesheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 147 days.

(21) Appl. No.: 10/736,541

(22) Filed: Dec. 17, 2003

(65) Prior Publication Data

US 2004/0144510 A1 Jul. 29, 2004

Related U.S. Application Data

(60) Provisional application No. 60/435,346, filed on Dec. 23, 2002.

(51) Int. Cl.
*D21H 21/20* (2006.01)
*D21H 17/33* (2006.01)

(52) U.S. Cl. ..... 162/158; 162/141; 162/164.3; 162/164.6; 162/168.3; 162/165

(58) Field of Classification Search ..... 162/158, 162/141, 164.3, 164.6, 168.3, 165
See application file for complete search history.

(56) References Cited

U.S. PATENT DOCUMENTS

| | | | | |
|---|---|---|---|---|
| 5,316,623 | A | 5/1994 | Espy | |
| 5,437,766 | A | 8/1995 | Van Phan et al. | |
| 5,490,904 | A * | 2/1996 | Jansma et al. | 162/168.2 |
| 5,611,890 | A * | 3/1997 | Vinson et al. | 162/111 |
| 5,690,790 | A * | 11/1997 | Headlam et al. | 162/175 |
| 5,935,383 | A * | 8/1999 | Sun et al. | 162/158 |
| 5,958,185 | A * | 9/1999 | Vinson et al. | 162/111 |
| 6,068,734 | A * | 5/2000 | Wallenius et al. | 162/141 |
| 6,083,348 | A * | 7/2000 | Auhorn et al. | 162/183 |
| 6,261,679 | B1 * | 7/2001 | Chen et al. | 428/317.9 |
| 6,294,645 | B1 * | 9/2001 | Allen et al. | 528/339.3 |
| 6,395,957 | B1 * | 5/2002 | Chen et al. | 604/381 |

FOREIGN PATENT DOCUMENTS

| | | |
|---|---|---|
| EP | 0 675 225 | 10/1995 |
| WO | WO97/04171 | 2/1997 |

* cited by examiner

*Primary Examiner*—Steven P. Griffin
*Assistant Examiner*—Dennis R. Cordray
(74) *Attorney, Agent, or Firm*—Young & Thompson

(57) ABSTRACT

Soft and strong cellulose-based fibrous web, comprises a) cellulosic fibres having a freeness value of more than 26° SR measured according to DIN-ISO 5267/1 (March 1999),
b) a water-soluble cationic polymer,
c) a water-soluble anionic polymer, and
d) a cationic surfactant-based softener.

Figure 1:
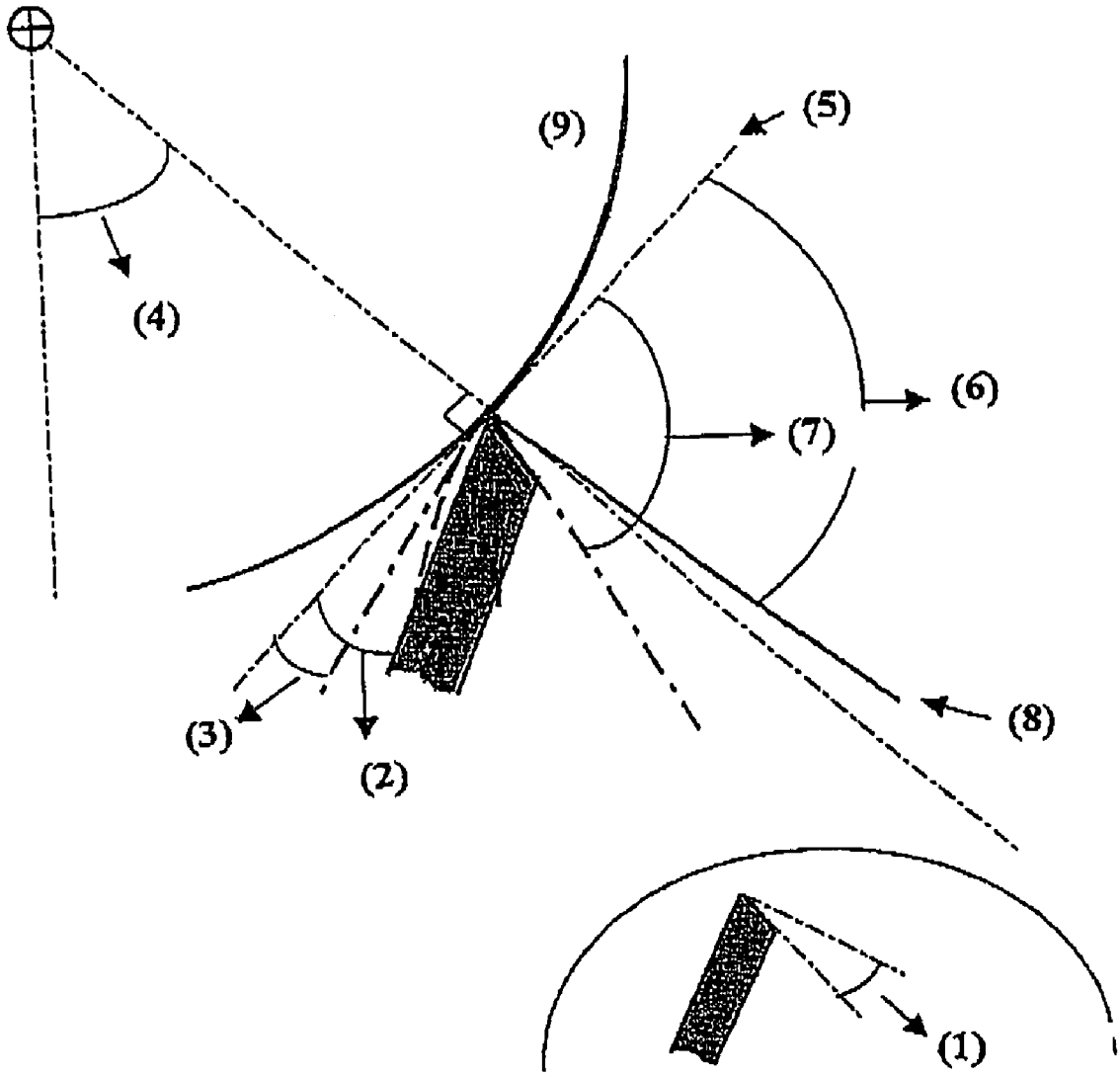

The webs are prepared by refining cellulosic fibres to a degree of freeness of more than 26° SR measured according to DIN-ISO 5267/1,
adding at least one water-soluble anionic polymer and water-soluble cationic polymer to the refined cellulosic fibres,
adding a cationic surfactant-based softener to the cellulosic fibres obtained thereby, and
wet-laying and dewatering the celulosic fibres obtained thereby.

37 Claims, 1 Drawing Sheet

SOFT AND STRONG WEBS FROM HIGHLY REFINED CELLULOSIC FIBRES

The present invention relates to a soft and strong web, in particular tissue paper, which is prepared from highly refined cellulosic fibres to which specific chemical additives are given. The present invention also pertains to a process for the manufacture of such web.

BACKGROUND OF THE INVENTION

Cellulosic webs, such as non-woven or paper tissue webs, find extensive use in modern society. Facial tissues, toilet tissues, kitchen paper or tissue handkerchiefs are staple items of commerce.

Among the most important physical properties of these products are their strength, their softness, their absorbency, primarily for aqueous systems, and their lint resistance.

Tissue paper products are often exposed to extremely varied strength requirements in the wet and dry states. For instance, it must be ensured, in the case of household paper (kitchen towels) that they retain their strength at least for a specific period of time when exposed to aqueous liquids or moisture-containing food. On the other hand, toilet paper should dissolve in water, some time after use, in order to prevent the sewage systems from clogging up. At the same time, toilet paper must not immediately use its strength properties during use for apparent reasons. Correspondingly, the prior art makes a distinction between dry strength and wet strength properties, the latter being divided in further categories such as initial wet strength, temporary wet strength and permanent wet strength depending on the point of time of measuring the wet strength after re-wetting a dry tissue paper.

A paper of an untreated cellulose-containing fibrous material usually looses 95% to 97% of its dry strength when saturated with water so that it normally cannot be used in the moistened or wet state. This is due to the fact that the paper develops dry strength as a result of inter-fibre hydrogen bonds which are broken up by water.

The use of wet strength resins, such as polyamidoamine-epichlorohydrine resin is a widely known counter measure, However, if these resins are used alone, they typically lead to tissue paper which is fairly stiff and has almost the haptic properties of normal paper.

The isolated use of softeners such as the typically employed quaternary ammonium compounds, on the other hand, reduces the strength since softeners also interact with inter-fibre hydrogen bonds, Further, they can decrease the absorbency due to hydrophobic effects.

These are typical examples for the generally occurring problem in the art of tissue paper making that the above-mentioned four properties conflict each other in so far as attempts to improve one property can be detrimental for another.

Therefore, the prior art describes many processes for achieving a suitable balance of softness, strength (dry and wet strength), lint properties and absorbency which shall be exemplified in the following.

WO 00/39398 relates to chemically modified cellulosic materials that can have improved properties such as wet strength, softness or absorbency. This document discloses a process comprising:

a) chemically attaching anionic groups, preferably carboxymethyl groups, via etherification to the surface of a cellulosic web fibre, for instance by, an alkaline treatment with sodium chloroacetate, and b) adding one or more cationic additives prior to web forming to form an ionic association between the cationic additive and the anionic fibre and c) forming a wet-laid sheet.

The cationic additive is selected from the group consisting of a wet strength resin, a debonder, a softening agent, a dewatering aid and a sizing agent.

However this technique is cumbersome, since it requires pre-reacting the pulp with an anionic groups-forming reagent (preferably a carboxymethyl-forming reagent) prior to sheet forming processes.

The process according to U.S. Pat. No. 5,316,623 is intended to provide a better absorbency as well as better wet and dry strength in paper towels or other tissue products. According to the teaching of this document, the following three ingredients are to be combined:

(A) a neutral or alkaline-curing thermosetting wet strength resin obtainable by reacting epichlorohydrine with polyaminoamide, polyamine or an aminopolymer.

(B) a water-soluble anionic polymer containing carboxyl groups or carboxylate ions such as carboxymethyl cellulose, and (C) a non-thermosetting tertiary amino polyamide-epichlorohydrine resin.

U.S. Pat. No. 3,755,220 discloses soft cellulosic sheet materials having an improved ratio of wet tensile strength to dry tensile strength. This is achieved by including in the papermaking furnish at least one water-soluble, thermosetting cationic resin, such as polyamide-epichlorohydrin resin and at least one debonder including anionic and cationic surface-active agents, in particular cationic, quaternary ammonium compounds.

EP 0 672 781 A2 discloses pre-wettable high softness paper having temporary wet strength. According to the teaching of this document, temporary wet strength agents and cationic nitrogenous softeners are preferably combined.

U.S. Pat. No. 5,573,637 discloses a multi-layered tissue paper product comprising a softener composition (quaternary ammonium compound and polysiloxane) and binders materials, either wet strength binders, such as polyamido-epichlorohydrine resins and/or dry strength binders such as carboxyethyl cellulose (CMC) where the majority of the softener composition is contained in the outer layers.

U.S. Pat. No. 3,998,690 relates to a process for the preparation of fibrous assemblies such as paper having advantageous properties such as wet strength, absorbency, softness, good drape and enhanced bulk which exhibit compaction resistance.

The process for the preparation of these fibrous assemblies comprises the steps of a. forming separate anionically charged and cationically charged fibre slurry aliquots, b. mixing the anionically and cationically charged aliquots, c. collecting the resulting discrete fibre aggregates and d. draining and drying said aggregates.

The cationic materials for the practice of this invention include quaternary ammonium compounds and common wet strength additives, such as aminopolyamide reaction products with epichlorohydrine. Carboxyethyl cellulose is mentioned as one among many additives for anionically charging the fibres.

U.S. Pat. No. 5,437,766 aims at providing soft, absorbent, lint resistant multiply-tissue paper products. For this purpose a. paper making fibres are treated with b. a biodegradable quaternary ammonium compound c. a water soluble polyhydroxy compound d. a wet strength binder, for instance, polyamide epichlorohydrine resins, and e. a. dry strength binder, for instance, carboxymethyl cellulose.

The majority of the softener composition (biodegradable quaternary ammonium compound and polyhydroxy compound) is contained in the outer layers of the plies According to the examples of this US Patent, two individually treated furnish streams are kept separate through the headbox and deposited onto a fourdrinier wire to form a two layer embryonic web.

The inner layer is prepared from a gently refined NSK (northern softwood Kraft) fibre slurry to which 2% Kymene wet strength resin and 1% CMC were given.

The second slurry being intended for the outer layer is prepared from eucalyptus fibres which were treated with Kymene, CMC and a 1% solution of the above-explained chemical softener mixture.

U.S. Pat. No. 6,162,327 discloses in its examples the use of similar treatment chemicals with the difference that Kymene, CMC and chemical softening mixture can be added to the NSK slurry.

It is an object of the present invention to provide a simple process for the preparation of fibrous webs, such as tissue paper having a high wet strength and simultaneously a suitable balance of other properties relevant for the web, such as dry strength, softness, bulk and absorbency.

It is a further object of the present invention to provide such fibrous web, in particular tissue paper.

SUMMARY OF THE PRESENT INVENTION

The present invention relates to soft and strong cellulose-based fibrous web, in particular tissue paper, comprising a) cellulosic fibres having a freeness value of more than 26° SR measured according to DIN-ISO 5267/1 (March 1999)

b) a water-soluble cationic polymer and c) a water-soluble anionic polymer, and d) a cationic surfactant-based softener, as well as a process for the preparation of these webs which comprises the steps of refining cellulosic fibres to a degree of freeness of more than 26° SR, preferably at least 27° SR, measured according to DIN-ISO 5267/1, adding at least one water-soluble anionic polymer and water-soluble cationic polymer to the refined cellulosic fibres, adding a cationic surfactant-based softener to the cellulosic fibres obtained thereby, and wet-laying and dewatering the cellulosic fibres obtained thereby.

The webs obtained are distinguished by a high wet-strength and a suitable balance of other properties such as softness, dry strength, bulk and absorbency.

FIGURE

FIG. 1 is a schematic drawing showing the creping process on a Yankee cylinder (9) with a creping blade. FIG. 1 gives a survey on the terminology used for the various angles influencing the creping process. In FIG. 1 represents (1) grind angle, (2) set up angle (blade unloaded), (3) wear angle (blade unloaded), (4) blade location, (5) Yankee tangent, (6) sheet take-off angle, (7) crepe pocket angle, (8) sheet run, (9) Yankee cylinder.

DETAILED DESCRIPTION OF THE PRESENT INVENTION

1. Cellulose-based Fibrous Web

The term "cellulose-based fibrous web" is used for planar assemblies comprising cellulosic fibres as disclosed below as major component, preferably in an amount of at least 70 weight %, based on the total fibre mixture. Contents of at least 80, or at least 90 weight % are even more preferred.

This cellulose-based fibrous web can, for instance, be a non-woven or a paper, for instance writing paper, packaging paper, filter paper or, in particular, a tissue paper.

The web (tissue paper or nonwoven) may be one-ply or multiple-ply. Each ply may have more than one, typically two or three layers. If the web contains more than one ply, it is preferred that the highly refined fibres (a), the cationic polymer (b), the anionic polymer (c) and the softener (d) are combined in one ply. Where one ply contains more than one layer, it is preferred that highly refined fibres (a), the cationic polymer (b), the anionic polymer (c) and the softener (d) are combined in one layer. This does not exclude that one or more of chemicals (b), (c) or (d) are also present in other plies or layers. In order to optimise the overall haptic and strength properties of multi-ply products, it can be desirable to apply the invention in that ply or those plies which are primarily responsible for the overall strength of the multi-ply assembly while using for that outer ply or outer plies which come in contact with the skin of the user a ply distinguished by an even greater softness. Correspondingly it is preferred for multi-layered plies to make use of the invention in the inner layer while using an even softer material for the outer layer (hereinbefore "outer" means that ply or layer which can come in contact with the skin of the user in the final product).

As to the term "nonwoven" (German terms "Vlies" and "Vliesstoffe"), this is applied to a wide range of products which in terms of their properties are located between the groups of paper, paperboard, and cardboard on the one hand and the textile products on the other (see ISO 9092-EN 29092). The invention allows the application of known processes using aqueous slurries of cellulosic materials for producing nonwovens for instance by so-called "hydroentanglement".

Nonwovens may also be called textile-like composite materials, which represent flexible porous fabrics that are not produced by the classic methods of weaving warp and weft or by looping, but by intertwining and/or by cohesive and/or adhesive bonding of fibres which may, for example, be present in the form of endless fibres or prefabricated fibres of a finite length, as synthetic fibres produced in situ or in the form of staple fibres. The nonwovens according to the invention may thus consist of mixtures of synthetic fibres in the form of staple fibres (e.g. up to 30% by weight based on the total fibre mixture) and cellulosic fibres treated according to the invention.

Based on the underlying compatibility of the production processes (wet laying), "tissue" production is counted among the paper making techniques. The production of tissue is distinguished from paper production by its extremely low basis weight and its much higher tensile energy absorption index.

In processing cellulosic fibres to one ply raw tissue paper, one generally selects a basis weight of 8 to 50 g/m$^2$, in particular 10 to 30 g/m$^2$, especially 12 to 25 g/m$^2$. The total basis weight of multiple-ply tissue products preferably does not exceed 75 g/m$^2$ and more preferably is equal to a maximum of 45 g/m$^2$.

The tensile energy absorption index is arrived at from the tensile energy absorption in which the tensile energy absorption is related to the test sample volume before inspection (length, width, thickness of sample between the clamps before tensile load). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper. A high tensile energy absorption index can also be achieved by imparting the tissue a 3D structure through the wires themselves. Most of the functional properties typical of tissue and tissue products result from the high tensile energy absorption index (see DIN EN 12625-4 and DIN EN 12625-5).

The term "tissue paper" as used herein covers the "raw tissue paper" as obtained from the tissue paper machine as well as one-ply or multi-ply final products ("tissue paper products") made of raw tissue and tailored to the end user's needs by further converting steps.

Typical properties of tissue paper include the ready ability to absorb tensile stress energy, their drapability, good textile-like flexibility, properties which are frequently referred to as bulk softness, a high surface softness, a high specific volume with a perceptible thickness, as high a liquid absorbency as possible and, depending on the application, a suitable wet and dry strength as well as an interesting visual appearance of the outer product surface. These properties allow tissue paper to be used, for example, as cleaning cloths, sanitary products (e.g. toilet paper), paper handkerchiefs, cosmetic wipes (facials) or as serviettes/napkins.

1.a Cellulosic Fibres

The cellulosic fibres to be used in the invention typically contain as main structure-building component the long chain fibrous cellulose portion which is present in naturally occurring cellulose-containing cells, in particular those of lignified plants. Preferably, the fibres are isolated from lignified plants by digestion steps removing or reducing the content of lignin and other extractables and optional bleaching steps.

The cellulosic fibres to be used may be of regenerated type (e.g. Lyocell), although the use of other types of pulps is preferred. The pulps employed can be a primary fibrous material or a secondary fibrous material (recycled pulps). The pulp can stem from lignin-free or low lignin sources, such as cotton linters, esparto (alfa) grass, bagasse (e.g. cereal straw, rice straw, bamboo, or hemp), kemp fibres or flax. Preferably the pulp is produced from ligno-cellulosic material, such as softwood (which typically originates from conifers) or hardwood (typically from deciduous trees).

It is possible to use "chemical pulps" or "mechanical pulps", whereby the use of chemical pulps is preferred.

"Chemical pulps" are, according to DIN 6730, fibrous materials obtained from plant raw materials of which most non-cellulosic components have been removed by chemical pulping without substantial mechanical post treatment. "Mechanical pulp" is the general term for fibrous material made of wood entirely or almost entirely by mechanical means, optionally at increased temperatures. Mechanical pulp can be sub-divided into the purely mechanical pulps (groundwood pulp and refined mechanical pulp) as well as mechanical pulps subjected to chemical pre-treatment, such as chemo-mechanical pulp (CMP), or chemo-thermo mechanical pulp (CTMP).

In the present invention it is preferred to use chemical pulps as derived from sulfite or sulfate (Kraft) processes.

In terms of bleaching the pulp, it is preferred to use chlorine-free bleaching steps in view of the production of environmentally sound products and process steps.

The present inventors have found that the gentle refining (beating) of cellulosic fibrous materials to a freeness value of about 18-25° SR (all ° SR freeness values mentioned herein are measured according to DIN-ISO 5267/1, March 1999) does not lead to sufficient wet strength, if further the typically used cationic wet strength resins, such as polyamidoamine-epichlorohydrine resins, are added to the fibrous materials. Without being bound to theory, it is believed that this may be due to the insufficient retention of the wet strength resin on the fibre surface. The inventors have found that further increasing the degree of refinement and treating the resultant fibres with a suitable combination of additives as explained below increases the wet strength of the fibrous web, in particular tissue paper obtained, but simultaneously maintains a suitable balance of other properties.

Therefore, it is an essential feature of the present invention to refine the cellulosic fibres to a freeness value of more than 26° SR.

The techniques and preferred embodiments used in the refinement step will be explained below in the context of the process of the invention.

Preferably the cellulosic fibres are refined to a freeness value of at least 27, more preferably at least 28, in particular at least 29° SR. Ranges of from 30 to 40, in particular 32 to 38° SR are even more preferred.

In related prior art processes such high degree of refinement has not yet been considered, possibly since a negative impact on the dewatering capacity of the resulting embryonic fibrous web, its permeability (of relevance in TAD processes explained below) and/or its capacity to adopt and preserve a 3D profile as being imparted by wires and TAD fabrics were expected. Therefore it was believed that, in particular, TAD processes could not be conducted with a highly refined pulp. However, in the present invention these detrimental effects were not observed to a degree which could interfere with an efficient preparation process.

The cellulosic fibres to be used can represent a mixture of unrefined or gently refined fibres (about more than 15 to 26° SR) and refined fibres (more than 26° SR) in accordance with the invention.

Further, it is also possible to use the present invention in the formation of multi-layered tissue paper by leading at least two different pulp streams, i.e. at least one of highly refined fibres treated according to the invention and at least one different pulp stream, to a multi-layered headbox.

When preparing multi-layered tissue plies, it is preferred to use as outer layer which may come into contact with the user's skin, the softer type of fibres, for instance unrefined or gently refined hardwood fibres or unrefined or gently refined softwood fibres.

The term "unrefined fibres" is used for fibres as naturally occurring or being obtained by their respective preparation process. (chemical or mechanical pulping, recycling etc.). Unrefined fibres, typically have a freeness value of about 12 to 15° SR.

Preferably, at least a part of long fibres to be used are refined. Long fibres typically stem from softwood (Gymnosperms) and have a fibre length in the range from 3.5 to 5.0 mm. They are normally pulped by Kraft processes. Preferred sources for the refined fibres are thus pine, spruce and Douglas fir.

The unrefined or gently refined fibres can be short fibres which generally stem from hardwood (Angiosperms) and have a size in the order from 1.0 to 2.0 mm. Hardwood is preferably pulped by sulfite processes. Preferred sources for the unrefined short fibres are eucalyptus, aspen or birch.

The unrefined or gently refined fibres can also stem from softwood, e.g. softwood like spruce digested by sulfite processes.

If long refined fibres and gently refined or unrefined fibres are to be combined, be it in a single-layered ply as a true mixture or in multi-layered plies based on separate pulp streams, they are preferably used in a ratio of from 90/10 to 10/90, more preferably 80/20 to 20/80, most preferably from 75/25 to 40/60.

1.b Water-Soluble Cationic Polymer

The water-soluble cationic-polymer is preferably added to the cellulosic fibres in such an amount that 0.01 to 5 weight %, more preferably 0.01 to 3 weight %, in particular 0.5 to 2 weight % (e.g. 0.5 to 1.5 weight %), based on the total amount of untreated cellulosic fibres (dry weight, EN 20638: 1993) is retained.

The cationic polymer to be used contains cationic groups, such as positively charged quaternary nitrogen atoms in sufficient amounts to impart the molecule water solubility preferably "water-soluble" means solubility in water (at 20° C.) of at least 1 g/l, preferably at least 10 g/l, in particular at least 20 g/l.

Preferably, the cationic water-soluble polymer is a wet strength agent. It can be selected from, but is not limited to urea-formaldehyde resins, melamine-formaldehyde resins, polyvinylamine, polyureide-formaldehyde resins, glyoxal-acrylamide resins and cationic materials obtained by the reaction of polyalkylene polyamines with polysaccharides such as starch and various natural gums, as well as 3-hydroxyazetidinium ion-containing resins, which are obtained by reacting nitrogen-containing polymers with epichlorohydrine. The above materials are mentioned in U.S. Pat. No. 3,998,690 where also references for their disclosure are found.

The most preferred type of cationic polymer are 3-hydroxy azetidinium ion-containing resins. They include, but are not limited to, neutral or alkaline-curing thermosetting wet strength resins which can be selected from polyaminoamide-epichlorohydrine resins, polyamine-epichlorohydrine resins and aminopolymer-epichlorohydrine resins. In this context, explicit reference is made to a more detailed description of these wet strength agents in the section from column 2, line 43 to column 3, line 23 of U.S. Pat. No. 5,316,623. Examples of these are the well known Kymene® resins available from Hercules Inc. or EKA XP 4016 available from Eka Chemicals.

1.c Water-Soluble Anionic Polymer

The water soluble anionic polymer is preferably added to the cellulosic fibres in such an amount that 0.01 to 3 weight %, more preferably 0.1 to 2 weight %, in particular 0.2 to 1 weight %, based on the total amount of untreated cellulosic fibres (dry weight according to DIN EN 20638) is retained by the fibres.

As "water-soluble anionic polymers" we understand those polymers having a sufficient amount of anionic groups, preferably carboxy groups to be water soluble.

Preferably "water-soluble" means solubility in water (at 20° C.) of at least 1 g/l, preferably at least 10 g/l in particular at least 20 g/l.

The anionic polymer can be selected among known anionic dry strength agents.

The water soluble anionic polymer is preferably selected from polycarboxylic acids and anhydrides such as starch-based polymers, (meth)acrylic acid-derived polymers and copolymers, maleic-anhydride-derived copolymers, vinyl copolymers of carboxylic acids and cellulose-based polymers. These can be further exemplified by polyacrylates, polymethacrylates, maleic anhydride-vinyl acetate polymers, polyvinylmethylether-maleic anhydride copolymers, methacrylic acid-acryl amide copolymers, isopropenyl acetate-maleic anhydride copolymers, itaconic acid-vinylacetate colpoymers, alpha-methyl styrene-maleic anhydride copolymers, styrene-maleic anhydride copolymers, methyl methacrylate-maleic anhydride copolymers, acrylic acid-styrene copolymers, carboxymethyl cellulose, succinic half esters of cellulose, graft polymerised polyacrylate-polyssacharide copolymers, succinic half esters of starch and oxidation products of the above-listed polyssacharides.

Preferably starch-based polymers, vinyl copolymers of carboxylic acids and cellulose-based polymers are used. Among these, the use of carboxyalkylated polysaccharides, in particular carboxyalkylated cellulose, is most preferred.

The water-soluble carboxyalkylated polysaccharides include carboxymethyl cellulose (CMC), carboxymethyl hydroxycellulose (CMHEC), carboxymethyl hydroxypropylcellulose (CMHPC), carboxymethylguar (CMG), carboxymethylated locust bean gum, carboxymethyl starch and the like, and their alkali metal salts or ammonium salts.

Carboxymethylated polyssacharides are available with various degrees of substitution (D.S.), defined as the average number of (carboxymethyl) substituents per anhydroglucose unit in the polyssacharide. Carboxymethyl cellulose (CMC) is operable for use in the invention between D.S. about 0.4 (below which it is insoluble) to about 3. The range D.S. about 0.6 to about 1.5 is preferred; that of about 0.7 to about 1.2 is more preferred. Carboxymethylguar (CMG) between D.S. about 0.05 and about 2.0 is operable; preferred is the range about 0.1 to about 1.0, and more preferred is the range about 0.2 to about 0.5.

The above anionic polymers also include anionic polymers of acrylamide. These can be made by hydrolysis of an acrylamide polymer or-copolymer by means known to the art, or by colpolymerising acrylamide with acrylic acid or sodium acrylate and optionally another monomer under radical initiation, again by means known to the art. Also operable are poly(acrylic acid) or its salts such as sodium polyacrylate or ammonium poylacrylate. Other operable polymers in this group are poly(acrylic acid) and its salts, and poly(sodium acrylate).

Anionic polyacrylamides are available in various molecular weight ranges, and with mole fractions of acrylic acid or acrylate salt per units between about 5 and about 70 mole percent. For convenience, those with weight-average molecular weights (Mw) below about 1 million are preferred. One suitable example is a polymer named Accostrength® 86, produced by the American Cyanamid Company.

Preferred anionic polymers are, those available commercially, having carboxyl (or carboxylate salt) contents of about 0.5 to about 14 millequivalents per gram. CMC is most preferred of all the polymers.

Preferably the above-explained water soluble cationic polymer is used in higher amounts than the water soluble anionic polymer. Preferably the weight ratio cationic polymer/anionic polymer is from 1/1 to 10/1, more preferably 2/1 to 7/1, most preferably 3/1 to 5/1.

1.d Cationic Surfactant-Based Softener

This type of softener (in the prior art sometimes referred to as debonder) is preferably added to the cellulosic fibres in such an amount that 0.005 to 3 weight %, more preferably 0.01 to 2.5 weight %, in particular 0.5 to 2 weight %, based on the total amount of untreated cellulosic fibres (dry weight according DIN EN 20638) are retained by the fibres.

The softener to be used has a smaller molecular weight than the above-explained-anionic and cationic polymers. Whereas the latter preferably has molecular weights of at least 5000, in particular at least 10,000, preferred upper molecular weights for the softener are maximally 2,000, in particular maximally 1,000 (weight average molecular weight in each case).

The softener may be selected from quaternary ammonium compounds (e.g. quaternized protein compounds, silicone quaternaries or quaternized protein compounds) or cationic phospholipids of the type as described in WO 97/04171. All suitable surfactant-based softeners have the presence of a cationic unit (preferably quaternary ammonium unit) and a long chain aliphatic group having preferably 8 to 24, more preferably 14 to 22 carbon atoms in common. The long chain aliphatic group is preferably directly linked to the cationic group.

Further, it is preferred to use water-soluble or at least emulsifiable molecules. This means a sufficient solubility or emulsifiability at 20° C. in water to allow the preparation of aqueous solutions/emulsions which lead to a noticeable improvement in terms of wet strength, dry strength and softness if combined with cellulosic fibres. Preferably the softener shows a solubility/emulsifiability in water (at 20° C.) of at least 1 g/l, preferably at least 10 g/l in particular at least 20 g/l.

The quaternary ammonium compounds include, but are not limited to, compounds of the following formula (I), (II), (III) or (IV):

(I)

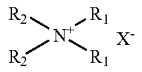

In formula (I), $R_1$, $R_2$ and $X^-$ have the following meanings;

$R_1$ is C10-22 hydrocarbon group, preferably a C12-18 hydrocarbon group, such as alkyl, which may have an ether oxygen and may be hydroxy-substituted. Ether oxygen and hydroxy group should not be linked to the same carbon atom and are preferably closer to the α-carbon atom (binding to the N-atom) than the ω-carbon atom of the hydrocarbon group. According to one embodiment $R^1$ is (C8-22)-alkyloxy (C2-6)-alkylen, preferably (C10-14)-alkyloxypropylen, wherein the alkylen or propylen unit is favorably hydroxy-substituted (e.g. 2-hydroxy propylene). One preferred softener of this type is Berocell 596 (1-propanaminium, 2-hydroxy-N-(2-hydroxypropyl)-N,N-dimethyl-, 3,3'-bis (C10-14 alkyloxy) chloride, available from Akzo Nobel Chemicals GmbH, Düren, Germany).

$R_2$ is a C1-C6-alkyl or hydroxyalkyl group or benzyl group, or a mixture thereof, preferably C1-C3 alkyl, such as methyl.

$X^-$ is a compatible anion, such as halide (e.g. chloride or bromide) or methyl sulfate.

$R^1$ may also represent a mixture of alkyl groups derived from natural sources, such as "tallow".

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention.

According to this preferred embodiment, each $R_1$ is C16-C18 alkyl, most preferably each $R_1$ is straight-chain C18 alkyl.

Biodegradable mono and di-ester variations of the quaternary ammonium compound can also be used, and are meant to fall within the scope of the present invention. These compounds preferably have the formulae (II), (III) or (IV) as follows:

(II)

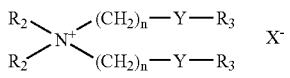

(III)

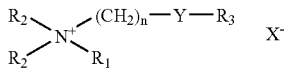

(IV)

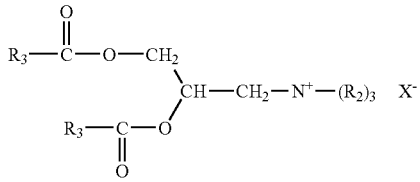

wherein each $R_2$ substituent is a C1-C6 alkyl or-hydroxyalkyl group, benzyl group or mixtures thereof; each $R_1$ substituent is a C12-C22 hydrocarbyl group, or substituted hydrocarbyl group or mixtures thereof, such as alkyl; each $R_3$ substituent is a C11-C21 hydrocarbyl group, or substituted hydrocarbyl, or substituted hydrocarbyl mixtures thereof, such as alkyl; Y is —O—C(O)—, —C(O)—O—, —NH—C(O)— or —C(O)—NH— or mixtures thereof, n is 1 to 4 and $X^-$ is suitable anion, for example, chloride, bromide, methylsulphate, ethyl sulphate, nitrate and the like.

It will be understood that substituents $R_1$, $R_2$ and $R_3$ may optionally be substituted with various groups such as alkoxyl, hydroxyl, or can be branched. Preferably, each $R_1$ is C12-C18 alkyl and/or alkenyl, most preferably each $R_1$ is straight-chain C16-C18 alkyl and/or alkenyl. Preferably, each $R_2$ is methyl or hydroxylethyl. Preferably, each $R_3$ is C13-C17 alkyl and/or alkenyl, most preferably $R_3$ is straight-chain C15-C17 alkyl and/or alkenyl, and $X^-$ is chloride or methyl sulphate. Furthermore, the ester functional quaternary ammonium compounds can optionally contain up to about 10% of the mono(long chain alkyl)

derivatives, e.g. $(R_2)_2—N^+—((CH_2)_2OH)$ $((CH_2)_2OC(O)R_3)X^-$ as minor ingredients. These minor ingredients can act as emulsifiers and are useful in the present invention.

Specific examples of ester-functional quaternary ammonium compounds having the structures named above and suitable for use in the present invention include the well known diester dialkyl dimethyl ammonium salts such as diester ditallow dimethyl ammonium chloride, monoester ditallow dimethyl ammonium chloride, diester ditallow dimethyl ammonium methyl sulphate, diester di(hydrogenated) tallow dimethyl ammonium sulphate, diester di(hydrogenated)tallow dimethyl ammonium chloride, and mixtures thereof. Diester ditallow dimethyl ammonium chloride and diester di(hydrogenated)tallow dimethyl ammonium chloride. These particular materials are available commercially from Witco Chemical Company Inc. of Dublin, Ohio under the tradename "ADOGEN DDMC®".

Di-quat variations of the ester-functional quaternary ammonium compound can also be used, and are meant to fall within the scope of the present invention. These compounds can have the formula (V):

(V)

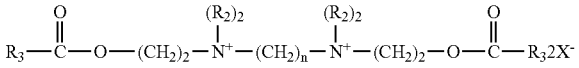

In the formula (V) above each $R_2$ is a C1-C6 alkyl or hydroxyalkyl group, $R_3$ is C11-C21 hydrocarbyl group, n is 2 to 4 and $X^-$ is a suitable anion, such as an halide (e.g. chloride or bromide) or methyl sulphate. Preferably, each $R_3$ is C13-C17 alkyl and/or alkenyl, most preferably each $R_3$ is straight-chain C15-C17 alkyl and/or alkenyl, and $R_2$ is a methyl.

It is possible to use the above surfactant-based cationic softener in combination with polyol or polysiloxane softeners of the type and in the amounts disclosed in U.S. Pat. No. 5,437,766 and U.S. Pat. No. 5,573,637. However, one advantage of the present invention is that sufficient softening can be achieved without these compounds.

Analysis of treatment chemicals herein retained on tissue paper webs can be performed by any method accepted in the applicable art. For example, the level of quaternary ammonium compound retained on the tissue paper can be determined by solvent extraction by an organic solvent followed by an anionic/cationic titration using Dimidium Bromide as indicator; the level of wet strength resin, such as polyamido epichlorohydrin resin can be determined by subtraction from the total nitrogen level, as obtained via a nitrogen analyser, the amount of quaternary ammonium compound level, determined by the above titration method. Further, an indirect determination of the amount of wet strength resin retained by the tissue paper web can be performed by measuring adipic acid levels, Moreover, it is possible to determine the amount of treatment chemicals retained by the tissue paper web indirectly by measuring the amount remaining in the treatment solution after treatment and subtracting the same from the total amount used. These methods-are exemplary and are not meant to exclude other methods, which may be useful for determining levels of particular compounds retained by the tissue paper. Further, the applicable methods are to be determined according to the general knowledge of a skilled person for the individual system to be measured.

2. Process for the Preparation of the Fibrous Web

The present process for the preparation of a cellulose based fibrous web comprises the steps of:

(i) refining cellulosic fibres to a degree of freeness of more than 26° SR measured according to DIN/ISO-5267/1, (ii) adding at least one water soluble anionic polymer and at least one water soluble cationic polymer to the refined cellulosic fibres, (iii) adding a cationic surfactant-based softener to the cellulosic fibres obtained thereby, and (iv) wet laying and dewatering the cellulosic fibres obtained thereby.

The cellulosic fibrous material, the additives and their properties are preferably as described before.

If tissue paper is to be produced, the manufacture process comprises preferably the following steps:

a. refining cellulosic fibres to a degree of freeness of more than 26° SR, b. preparing an aqueous slurry comprising the refined fibres, c. adding at least one water-soluble anionic polymer and water-soluble cationic polymer (preferably in this order) to the aqueous slurry comprising the refined cellulosic fibres, d. thereafter adding a cationic surfactant-based softener to the aqueous slurry comprising the cellulosic fibres obtained thereby, preferably shortly before entering the headbox, and e. wet-laying and dewatering to a coherent fibrous web having preferably a consistency of from 8 to 25%, f. optionally pressing the wet web (which is, for instance, not required for TAD processes explained below), g. drying and creping the dewatered and optionally pressed web.

When preparing the pulp for the refinement step, common techniques as used in the art can be used, for instance, fractionating, sorting, washing, floating, cleaning and thickening and/or fiberizing.

Then, the cellulosic material is transported to a refiner unit. Fibrillation of the fibres during refinement (beating) occurs either by the fibres themselves or by the refiner knives. During refinement, the fibres are subjected to a variety of physical loads. Axial and tangential shearing and compressive forces acting upon the fibre play a particular role as regards fibre refining. The associate change in fibre morphology involves but is not limited to tearing open and removing the fibrous materials outer wall layer (primary wall) and/or exposing the fibres and fibrillation out of the wall layers and/or partially shorting the total fibre unit and/or shearing off fibrils.

The influenced of the cutting angle of the bars and groves attached to the refiner unit in relation to the change in characteristic of the fibrous material are described in PTS Research Report: G. Bär, *Faserstoffoptimierung durch modifizierten Mahlprozess* PTS-FB 19/98, 1st edition, (1998).

Depending on the refiners operation mode, fibres are shortened (cut) or fibrillated as stated above. According to the present invention an operating mode leading to fibrillated fibres is preferred since it is believed to substantially increase the surface accessibility and the binding capacity of the fibres.

After refining the cellulosic fibres to a freeness value of more than 26° SR, an aqueous slurry is produced therefrom. The slurry preferably contains the cellulosic fibres in an amount of from 3 to 4 weight %, based on the water content.

After further dilution, preferably to consistencies in the order of 0.5 to 1.5 weight % (e.g. 0.8 to 1.2 weight %), this slurry is treated with the anionic and cationic water soluble polymer. Preferably aqueous solutions are used for adding these chemicals but it is also possible to add them in substance.

Generally it is preferred, to add the anionic polymer first (prior to the cationic polymer) in order to ensure an optimal interaction with the cellulosic fibres. After a period of time of preferably 30 sec to 24 hours, in particular 1 to 30 min, the cationic polymer is also given to the aqueous slurry. Again it is preferred to let a certain period of time pass (preferably from 1 to 30 min) before the aqueous slurry is conducted to the headbox and dewatered.

According to a further preferred embodiment it is also possible to add the polymers in the order:

"first" cationic polymer— anionic polymer—

"second" cationic polymer.

whereby the "second" cationic polymer corresponds to the previously-described cationic polymer. The "first" cationic may be identical with or different from the "second" cationic polymer. The "first" cationic polymer is added to bind minor amounts of anionic matters (impurities) being present in the refined pulp to be treated and interfering with the interaction between anionic polymer and fibre surface. It is preferred to use as "first cationic polymers" so-called promoters, such as cationically modified polyacrylamides (e.g. Cypro 514 produced by Cytec Inc.) The addition of anionic polymer and "second" cationic polymer then preferably follows the above conditions. The total amount of "first" and "second", cationic polymer are within the amounts given hereinbefore for the cationic polymer in general.

However, it is also possible to reverse the order of addition by adding first the cationic polymer. Further, it is within the scope of the present invention to add the anionic polymer a second time, after the addition of the cationic polymer, but prior to the softener. This second addition can be used for adjusting surface charges and preferably takes place shortly before wet-laying and dewatering to an embryonic web.

Shortly before wet-laying, preferably 5 sec to 5 minutes before wet laying, the third chemical, the cationic surfactant-based softener is preferably added (as solution or in substance) to the aqueous slurry.

It is also possible to treat the already wet-laid web with the softener, for instance before the TAD section or between TAD section and Yankee cylinder, e.g. with a conventional spray boom. However, this seems to lead to less favourable wet strength.

For an optimal processability in the paper machine, all three chemicals (anionic and cationic polymer, softener) are preferably added in an order and amounts ensuring a streaming current potential of white-water of the paper machine which ranges from −50 to −30 μeq/g. On the other hand, it is also possible to operate the paper machine with other potential values than stated above. TAD machines can for instance be run with a positive streaming current potential of white-water, e.g. +5 to +20 μeq/g.

The streaming current potential is measured in a teflon-coated device equipped with an oscillating piston which shears off charges from the fiber surfaces being present in the white-water. Such devices (e.g. streaming current detector PCD 03 pH, available from Mütek Analytic GmbH, Germany) are commercially available. When measuring the current potential, the procedure and requirements given by Mütek Analytic GmbH for detector PCD 03 pH are preferably to be followed.

Further, it is preferred to add the three chemicals b), c) and d) to aqueous slurries having pH-values in the order of 6.5 to 8, more preferably >7 to 7.5 to ensure an optimal interaction with the fibre surface.

The wet laying step and the further production steps are performed in line with methods known in the art.

If tissue paper is to be made from the pulp according to the invention, the process essentially comprises:

a. forming that includes the headbox and the wire section,
b. optionally the press section (which is not required for TAD processes)
c. the drying portion (TAD (through air drying)) and/or conventional drying on the yankee cylinder) that also usually includes the crepe process essential for tissues,
d. typically the monitoring and winding area.

Paper can be formed by placing the fibres, in an oriented or random manner, on one or between two continuously revolving wires of a paper making machine while simultaneously removing the main quantity of water of dilution until dry-solids contents of usually between 8 and 35% are obtained.

The forming wire is often referred to in the art as a Fourdrinier wire. Once the furnish is deposited on the forming wire, it is referred to as a web. The web is dewatered by transferring to a dewatering felt, pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fibre consistency of between about 8% and about 35% (total web weight basis) by vacuum dewatering and further dewatered by pressing operations wherein the web is subjected to pressure developed by opposing mechanical members, for example, cylindrical rolls.

Drying the formed primary fibrous web occurs in one or more steps by mechanical and thermal means until a final dry-solids content of usually about 93 to 97%. In the case of tissue making, this stage is followed by the crepe process which crucially influences the properties of the finished tissue product in conventional processes. The conventional dry crepe process involves creping on a usually 4.5 to 6 m diameter drying cylinder, the so-called Yankee cylinder, by means of a crepe doctor with the aforementioned final dry-solids content of the raw tissue paper (wet creping can be used if lower demands are made of the tissue quality). The creped, finally dry raw tissue paper (raw tissue) is then available for further processing into the tissue paper product according to the invention.

If the tissue paper is to be creped on the Yankee cylinder, the set up angle (reverence number (2) in FIG. 1) is preferably determined to be from 10 to 35°. For non-TAD processes values of 11 to 13° are typically employed. If TAD technology as explained below is used, the set up angle preferably ranges from 20 to 35°, in particular 22 to 30°.

When practising the present invention, the geometry of the doctor blade relative to the tissue surface may also have an impact of the properties of the product obtained. Thus, thickness and relative wet strength may increase, when the grind angle is increased from 20° over 25° to 30°. This applies in particular to TAD processes as follows. As "grind angle" we understand the angle (1) given in FIG. 1.

Instead of the conventional tissue making process described above, the invention gives preference to the use of a modified technique in which an improvement in specific volume is achieved by a special kind of drying within process section (c) and in this way an improvement in the bulk softness of the thus made tissue paper is achieved. This process, which exists in a variety of subtypes, is termed the TAD (through air drying) technique. It is characterized by the fact that the "primary" fibrous web that leaves the sheet making stage is pre-dried to a dry-solids content of e.g. about 80% before final contact drying on the yankee cylinder by blowing hot air through the fibrous web. The fibrous web is supported by an air-permeable wire or belt and during its transport is guided over the surface of an air-permeable rotating cylinder drum. Structuring the supporting wire or belt makes it possible to produce any pattern of compressed zones broken up by deformation in the moist state, resulting in increased mean specific volumes and consequently leading to an increase in bulk softness without decisively decreasing the strength of the fibrous web. Such a pattern is fixed in the area of the TAD-cylinder. Thereafter the pattern is further imprinted between the TAD-fabric and the Yankee-cylinder.

Creping may be conducted also during transfer of the paper sheet from the forming wire directly to the TAD-fabric or via a transfer fabric. For this creping the forming fabric runs faster than the following fabric receiving the sheet (rush transfer). For example, when applying the TAD technique for the production of raw tissue and the usual double-screen sheet formation in c-wrap configuration, for example, the so-called inner sheet-forming screen can thus be operated at a speed that is up to 40% faster than that of the next fabric or that of the subsequent felt, the initially formed and already pre-drained paper web being transferred to the next TAD fabric. This causes the still moist and as a result plastically deformable paper-web to be internally broken up by compression and shearing, thereby rendering it more stretchable under load than a paper that has undergone neither "internal" nor external creping. This transfer of still plastically deformable paper web at a differential speed that simultaneously takes effect may also be brought about in other embodiments between a transfer fabric and the so-called TAD imprinting fabric or between two transfer fabrics.

Another possible influence on the softness and strength of the raw tissue lies in the production of a layering in which the primary fibrous web to be formed is built up by a specially constructed headbox in the form of physically different layers of fibrous material, these layers being jointly supplied as a pulp strand to the sheet making stage.

When processing ("converting") the raw fibrous web or raw tissue paper into the final product, the following procedural steps are normally used individually or in combination; cutting to size (longitudinally and/or cross cutting), producing a plurality of plies, producing chemical and/or mechanical (e.g. by embossing) ply adhesion, volumetric and structural embossing, folding, imprinting, perforating, application of lotions, smoothing, stacking, rolling up.

To produce multi-ply tissue paper products, such as handkerchiefs, toilet paper, towels or kitchen towels, an intermediate step preferably occurs with so-called doubling in which the raw tissue in the finished product's desired number of plies is usually gathered on a common multiply master roll.

The processing step from the raw tissue that has already been optionally wound up in several plies to the finished tissue product occurs in processing machines which include operations such as repeated smoothing of the tissue, edge embossing to an extent combined with full area and/or local application of adhesive to produce ply adhesion of the individual plies (raw tissue) to be combined together; as well as longitudinal cut, folding, cross cut, placement and bringing together a plurality of individual tissues and their packaging as well as bringing them together to form larger surrounding packaging or bundles. The individual paper ply webs can also be pre-embossed and then combined in a roll gap according to the foot-to-foot or nested methods.

These converting techniques are known in the art.

3. EXAMPLES

The following test methods were used to evaluate the tissue papers produced. The test samples were conditioned over 12 hours at 50% relative humidity and 23° C. prior to testing.

3.1. Basis Weight

The basis weight was determined according to DIN EN 12625-6.

3.2. Anisotropy

The anisotropy was determined by dividing the dry breaking load value in machine direction (MD) through the dry breaking load value in cross direction (CD) as determined according to item 3.4 below.

3.3. Thickness

The measurement is made by a precision micrometer (precision 0.001 mm) according to a modified method based on EN 12625, part 3. For this purpose, the distance created by a sample between a fixed reference plate and a parallel pressure foot is measured. The diameter of the pressure foot is 35.7±0.1 mm (10.0 $cm^2$ nominal area). The pressure applied is 2.0 kPa±0.1 kPa. The pressure foot is movable at a speed rate of 2.0 ±0.2 mm/s.

A usable apparatus is a thickness meter type L & W 51D20 (available from Lorentzen & Wettre, US).

The paper to be measured, i.e. two sheets of a single-ply or multi-ply paper are cut into pieces of 20×25 cm and conditioned in an atmosphere of 23° C., 50% RH (Relative Humidity) for at least 18 hours.

During measurement the sheets are placed beneath the pressure plate which is then lowered. The thickness value for the sheet is then-read off 5 sec after the pressure value has stabilised. The thickness measurement is then repeated four times with further samples treated in the same manner.

The mean value of the 5 values obtained is taken as thickness of the two sheets measured.

3.4, Dry Tensile Strength in N/50 mm (MD+CD)

The dry strength was determined according to prEN 12625-4: 2001, Tissue Paper and Tissue Products, Part 4: Determination of width-related breaking strength, elongation at break and tensile energy absorption.

3.5. Wet Tensile Strength in N/50 mm (MD+CD)

The wet strength was determined according to prEN ISO/FDIS 12625-5:2001(E) Tissue Paper and Tissue Products, Part 5: determination of wet tensile strength (CEN TC 172).

To ensure that the wet strength of the samples has fully developed, the samples to be tested were always artificially aged before conducting the tensile test. Aging was effected by heating the samples in an air-circulating drying cabinet to (125±1) ° C. for a period of 10 min.

3.6. Relative Wet Tensile Strength (MD+CD),

The relative wet tensile strength (WS) was calculated as follows:

$$\text{rel. } TS = TS_{wet}/TS_{dry}$$

where $TS_{wet}$ is the tensile strength of the wet sample strip and $TS_{dry}$ is the tensile of the dry sample strip, and these values were ascertained in the manner described above.

3.7. Freeness Value

The freeness value (in ° SR) was measured according to DIN-ISO S5267/1; March 1999.

3.8. dry Weight.

The dry weight was determined according to DIN EN 20638 Pulp: determination of the dry-solids content (ISO 638: 1978); German version EN 20638:1993.

Hereinafter weight proportions ("Kg/t") always refer to the amount of treated cellulosic fibres (dry weight)

Example 1

A pilot scale TAD tissue paper making machine was used in the practice of the present invention.

First, an aqueous slurry of pine sulfate pulp (Grapho Celeste, available from SCA Östrand) was refined at a consistency of 3 weight % to a freeness value of 35° SR in a conical refiner (available from Sunds Defibrator) operating at 78 kWh/t.

After further dilution, 5 Kg/t of carboxymethylcellulose (trade name; Blanose 7LC, available from Hercules Inc., USA) were added to the pine sulfate pulp slurry at a consistency of about 1 weight %. The resulting slurry was left to stand for about 30 minutes. After this time 12.5 Kg/t polyamidoamine-epichlorohydrine (PAE) resin (Kymene® SLX, available from Hercules Inc., USA) were added.

Separately, unrefined spruce sulfite pulp (Excellent, available from SCA Mannheim) was treated at a consistency of about 1 weight % with 6.25 Kg/t of the sate PAE resin.

Both furnish streams were further diluted at the fan pump to a consistency of about 0.1 weight %.

Then, the highly refined furnish stream (35° SR) was treated with 0.9 Kg/t Berocell 596, a quaternary ammonium surfactant available from Akzo Nobel Chemicals GmbH, which was added to the inlet of the fan pump being installed shortly before the headbox.

The individually treated furnish streams were kept separate through the headbox and deposited onto a Fourdrinier wire to form a two layer embryonic web containing 70 weight % of the refined and treated pine sulfate pulp and 30 weight % of the unrefined treated sulfite pulp, respectively.

This embryonic web was carried through the TAD machine under the following conventional operating conditions:

| | |
|---|---|
| Yankee speed: | 1160 m/min |
| Rush: | 14% |
| Creping: | 0% (no speed difference between Yankee cylinder and pope roller) |
| Calander speed: | 0% |
| Calander gap: | 0.1 mm |
| Grind angle of creping blade: | 20° |
| Steam box pressure/temp: | 40 kPa/135° C. |
| Supply air temperature TAD section: | about 180° C. |
| Supply air pressure TAD section: | 50 mm W.C. |
| Dryness before Yankee: | 85% |

-continued

| | |
|---|---|
| Yankee pressure: | 500 kPa |
| Yankee hood temperature: | 260° C. |
| Outer forming fabric: | Albany Q 56 |
| Inner forming fabric: | Albany R 16 |
| TAD fabric: | Albany MST |

The web was adhered to the surface of the Yankee Cylinder by means of commercially available creping adhesives with the layer formed by sulfite pulp. After drying and creping, a single ply two layer raw tissue paper was obtained which has the properties shown in Table 1 below.

Comparative Example 1

A single ply two layer tissue paper was produced in the same manner as set forth in example 1 apart from the following two differences.

The pine sulfate pulp was refined to a freeness value of 26° SR only. Further, no softener (Berocell 596) was added to the refined pine sulfate pulp and unrefined spruce sulfite pulp, respectively.

The properties of the inventive example and the comparative example as shown below in Table 1 were measured according to the procedures explained hereinbefore. The results were as follows.

| | Comparative Example | Inventive Example |
|---|---|---|
| Basis Weight (g/m$^2$) | 23.95 | 22.85 |
| Anisotropy | 1.7 | 1.6 |
| Thickness (mm) of two single-ply sheets | 0.66 | 0.74 |
| Dry tensile strength (MD, N/50 mm) | 30.3 | 29.5 |
| Dry tensile strength (CD, N/50 mm) | 18.1 | 18.3 |
| Wet tensile strength (MD, N/50 mm) | 10.1 | 11.5 (+14%) |
| Wet tensile strength (CD, N/50 mm) | 6.5 | 7.8 (+20%) |
| Relative Wet Strength (MD) % | 33.3 | 39.0 |
| Relative Wet Strength (CD) % | 35.9 | 42.6 |

These test data show that the present invention can lead to an absolute increase in wet strength of 14% (MD) and about 20% (CD). Simultaneously, good dry strength values are obtained which are in the same order as in the comparative example. Further, the improved bulk (higher thickness) and the soft feeling of the tissue paper of the invention is to be noted.

The invention claimed is:

1. Cellulose-based fibrous web, comprising:

a) cellulosic fibres having a freeness value of more than 26° SR measured according to DIN-ISO 5267/1 (March 1999), b) a water-soluble cationic polymer, c) a water-soluble anionic polymer, and d) a cationic surfactant-based softener, wherein said fibres, polymers, and softener are provided so that said web has, for a basis weight of 23.95 g/m$^2$, a wet tensile strength in cross direction of more than 6.5 N/50 mm.

2. Cellulose-based fibrous web according to claim 1, wherein the cellulosic fibres have a degree of freeness of from 27 to 40° SR.

3. Cellulose-based fibrous web according to claim 1, wherein said product comprises refined and gently refined or unrefined fibres, said refined fibres having a freeness value of more than 26° SR.

4. Cellulose-based fibrous web according to claim 3, wherein the refined fibres are long softwood fibres and the gently refined or unrefined fibres are long softwood fibres or short hardwood fibres.

5. Cellulose-based fibrous web according to claim 3, wherein the amount of refined fibres ranges from 10 to 100 weight %, and the amount of gently refined or unrefined fibres ranges from 90 to 0 weight %, based on the total amount of cellulosic fibres.

6. Cellulose-based fibrous web according to claim 1, wherein said product comprises refined and gently refined or unrefined fibres, said refined fibres having a freeness value of more than 26° SR, wherein the refined fibres are long softwood fibres and the gently refined or unrefined fibres are long softwood fibres or short hardwood fibres and wherein the amount of refined fibres ranges from 10 to 100 weight %, and the amount of gently refined or unrefined fibres ranges from 90 to 0 weight %, based on the total amount of cellulosic fibres.

7. Cellulose-based fibrous web according to claim 1, wherein the water-soluble cationic polymer is present in an amount of 0.01 to 5 weight %, based on the total amount of (untreated) cellulosic fibres.

8. Cellulose-based fibrous web according to claim 1, wherein the cationic water-soluble polymer is selected from urea-formaldehyde, melamine-formaldehyde, polyureide-formaldehyde, glyoxal-acrylamide, polyaminoamide-epichlorohydrin resins, polyamine-epichlorohydrin resins or amine polymer-epichlorohydrin resins.

9. Cellulose-based fibrous web according to claim 8, wherein the cationic water-soluble polymer is selected from polyaminoamide-epichlorohydrin resins, polyamine-epichlorohydrin resins or amine polymer-epichlorohydrin resins.

10. Cellulose-based fibrous web according to claim 1, wherein the water-soluble anionic polymer is present in an amount of 0.01 to 3 weight %, based on the total amount of (untreated) cellulosic fibres.

11. Cellulose-based fibrous web according to claim 1, wherein the water-soluble anionic polymer is selected from starch-based polymers, (meth)acrylic acid-derived polymers and copolymers, maleic-anhydride-derived copolymers, vinyl copolymers of carboxylic acids and cellulose-based polymers.

12. Cellulose-based fibrous web according to claim 1, wherein the cationic water-soluble polymer is selected from polyaminoamide-epichlorohydrin resins, polyamine-epichlorohydrin resins or amine polymer-epichlorohydrin resins and the cellulose-based polymer is carboxyalkylated cellulose.

13. Cellulose-based fibrous web according to claim 1, wherein the weight ratio of water-soluble cationic polymer to water-soluble anionic polymer is from (3-5)/1.

14. Cellulose-based fibrous web according to claim 1, wherein the cationic surfactant-based softener is present in an amount of 0.005 to 3 weight %, based on the total amount of (untreated) cellulosic fibres.

15. Cellulose-based fibrous web according to claim 14, wherein the softener is a quaternary ammonium compound.

16. Cellulose-based fibrous web according to claim 1, wherein the cellulose-based web is tissue paper.

17. Cellulose-based fibrous web according to claim 1, wherein said web has a relative wet strength in cross direction of more than 35.9%.

18. Cellulose-based fibrous web according to claim 1, wherein said web has a wet tensile strength in cross direction of at least 7.8 N/50 mm.

19. Cellulose-based fibrous web according to claim 18, wherein said web has a relative wet strength in cross direction of at least 42.6%.

20. Cellulose-based fibrous web according to claim 1, wherein a ratio of the wet tensile strength in cross direction (N/50 mm) to the basis weight (g/m$^2$) is more than 5.4 Nm/g.

21. Cellulose-based fibrous web according to claim 20, wherein the ratio is at least 6.8 Nm/g.

22. Process for the preparation of a cellulose-based fibrous web comprising the steps of:

refining cellulosic fibres to a degree of freeness of more than 26° SR, measured according to DIN-ISO 5267/1, adding at least one water-soluble anionic polymer and water-soluble cationic polymer to the refined cellulosic fibres, adding a cationic surfactant-based softener to the cellulosic fibres obtained thereby, and wet-laying and dewatering the cellulosic fibres obtained thereby, wherein said fibres, polymers, and softener are provided so that said web has, for a basis weight of 23.95 g/m$^2$, a wet tensile strength in cross direction of more than 6.5 N/50 mm.

23. Process according to claim 22, wherein the degree of freeness is at least 27° SR.

24. Process according to claim 22, wherein long softwood fibres are refined in the refining step which are then admixed with unrefined short hardwood fibres prior to or after the addition of at least one water-soluble anionic polymer and at least one water-soluble cationic polymer.

25. Process according to claim 22, wherein the anionic water-soluble polymer is added to the cellulosic fibres and left to act upon the cellulosic fibres before the cationic water-soluble polymer is added.

26. Process according to claim 22, wherein the cationic polymer is added in such an amount that the final web contains an amount of 0.01 to 5 weight %, based on the total amount of (untreated) cellulosic fibres.

27. Process according to claim 22, wherein the cationic water-soluble polymer is selected from urea-formaldehyde, melamine-formaldehyde, polyureide-formaldehyde, glyoxal-acrylamide, polyaminoamide-epichlorohydrin resins, polyamine-epichlorohydrin resins or amine polymer-epichlorohydrin resins.

28. Process according to claim 27, wherein the cationic water-soluble polymer is selected from polyaminoamide-epichlorohydrin resins, polyamine-epichlorohydrin resins or amine polymer-epichlorohydrin resins.

29. Process according to claim 22, wherein the anionic polymer is added in such an amount that the final web contains an amount of 0.01 to 3 weight %, based on the total amount of (untreated) cellulosic fibres.

30. Process according to claim 22, wherein the water-soluble anionic polymer is selected from starch-based polymers, (meth)acrylic acid-derived polymers and copolymers, maleic-anhydride-derived copolymers, vinyl copolymers of carboxylic acids and cellulose-based polymers.

31. Process according to claim 22, wherein the cationic surfactant-based softener is added in such an amount that the final web contains an amount of 0.005 to 3 weight %, based on the total amount of (untreated) cellulosic fibres.

32. Process according to claim 22, wherein the softener is a quaternary ammonium compound.

33. Process according to claim 22 wherein said web has a relative wet strength in cross direction of more than 35.9%.

34. Process according to claim 22, wherein said web has a wet tensile strength in cross direction of at least 7.8 N/50 mm.

35. Process according to claim 34, wherein said web has a relative wet strength in cross direction of at least 42.6%.

36. Process according to claim 22, wherein a ratio of the wet tensile strength in cross direction (N/50 mm) to the basis weight ($g/m^2$) is more than 5.4 Nm/g.

37. Process according to claim 36, wherein the ratio is at least 6.8 Nm/g.

* * * * *